US006427729B1

(12) United States Patent
Teel

(10) Patent No.: US 6,427,729 B1
(45) Date of Patent: Aug. 6, 2002

(54) METHOD AND SYSTEM OF INDIRECT-PRESSURIZATION OF NATURAL GAS

(76) Inventor: James Rose Teel, P.O. Box 208, Bull Shoals, AR (US) 72619

( * ) Notice: Subject to any disclaimer, the term of this patent is extended or adjusted under 35 U.S.C. 154(b) by 0 days.

(21) Appl. No.: 09/867,369

(22) Filed: May 30, 2001

(51) Int. Cl.[7] ..... B65B 31/00; B67C 3/00

(52) U.S. Cl. ..... 141/4; 141/2; 141/18; 141/21; 141/25; 222/389

(58) Field of Search ..... 141/2, 18, 4, 25–28, 141/21, 39, 67, 82, 114; 222/3, 95, 105, 146.5, 386.5, 389; 137/267

(56) References Cited

U.S. PATENT DOCUMENTS 4,750,869 A * 6/1988 Shipman, III ..... 417/342

* cited by examiner

*Primary Examiner*—Timothy L. Maust

(57) ABSTRACT

A method and system of pressurizing natural gas, and/or other gaseous substances, indirectly, by pressurizing a liquid-filled chamber in which a flexible bladder has been inserted which holds the gas to be pressurized. This Indirect Pressurization Facility (IPF) will take small volumes of gas, at pressures less than the pressure inside a gas sales line, boost the pressure by pumping a liquid onto the outside of the bladder which collapses the bladder and re-positions the trapped gas into a smaller confinement which results in an increase in the pressure of the gas. When the increased pressure reaches a level above the sales line pressure, the gas will be squeezed out and into the sales line. The process is then repeated until the gas supply from the well declines to a point where it is no longer economically-justified to continue operations.

1 Claim, 1 Drawing Sheet

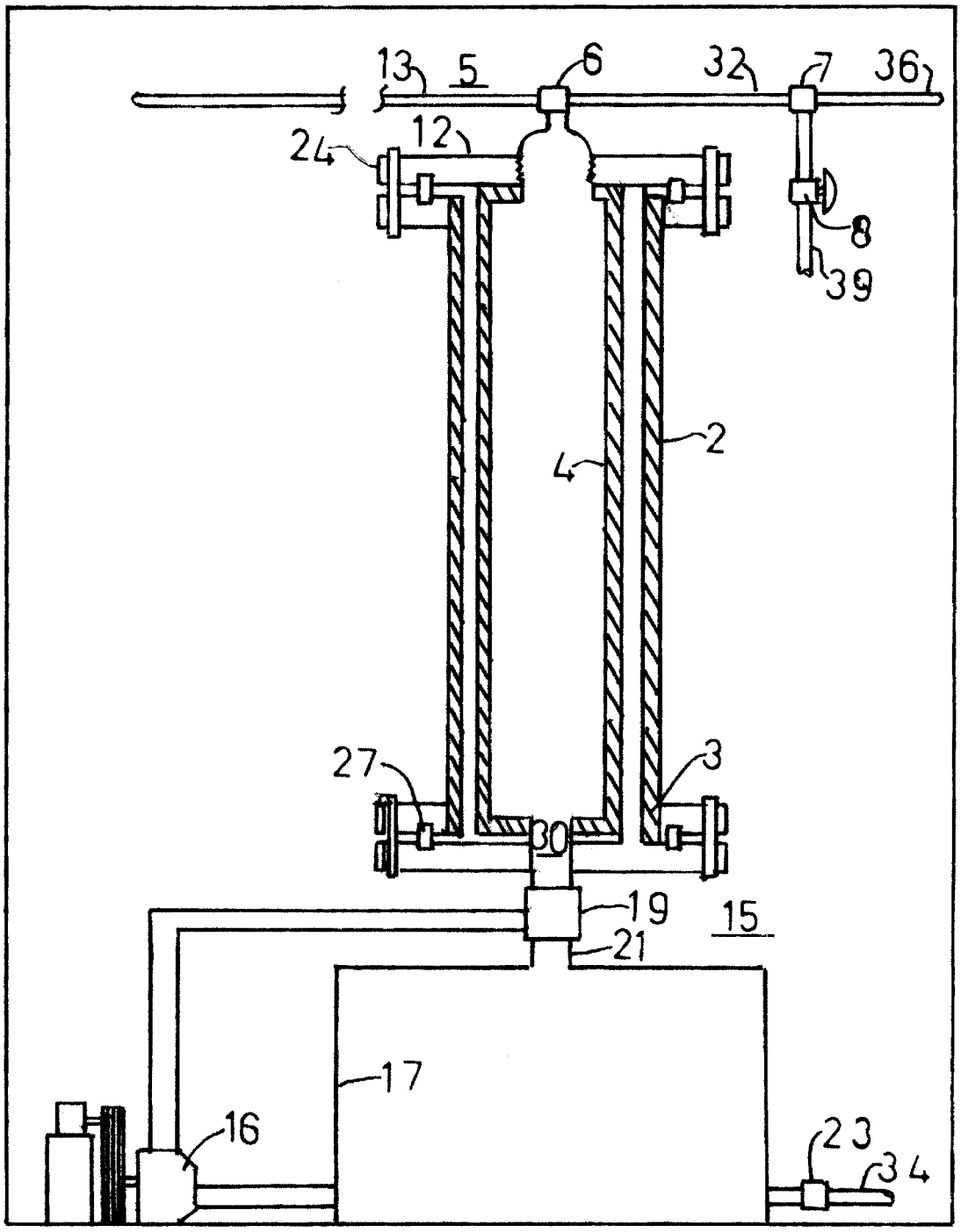
13
5
6
32
7
36
24
12
8
39
2
4
27
3
30
19
15
21
17
16
23
34

METHOD AND SYSTEM OF INDIRECT-PRESSURIZATION OF NATURAL GAS

CROSS-REFERENCES TO RELATED APPLICATIONS

U.S. patent application Ser. No. 08/454,531 now U.S. Pat. No. 5,603,360

U.S. patent application Ser. No. 08/615,690 now U.S. Pat. No. 5,676,180

U.S. patent application Ser. No. 09/039,272 now U.S. Pat. No. 5,908,141

BACKGROUND OF THE INVENTION

The present invention is a new low-cost method of boosting the pressure of a gas from a lower level to a higher level, for any purpose, one of which may be to inject the gas into a higher-pressure receptacle for purposes of sale, or to carry out some mechanical function. More particularly, it relates to such method and system especially adapted to the economics of the equipment used to increase the pressure (to pressurize or compress) the gas from a marginally-profitable gas well to a level acceptable for insertion into a gas sales line.

The present invention relates to a new low-cost method of compressing natural gas from a gas well when the reservoir pressure of the producing zone has declined below the pressure of the gas sales line. The present invention takes low-cost standard oil-field equipment and combines them into a unit that will compress gas more economically than a conventional compressor. The present invention relates, specifically, to the use of a flexible bladder inside a steel vessel, to receive and temporarily store natural gas from a gas well. In order to increase the pressure of the temporarily-stored gas inside the bladder, a hydraulic fluid is pumped into the annulus between the outer walls of the bladder and the inner walls of the steel vessel. With continued pumping, the pressure of the hydraulic fluid will exceed the gas pressure inside the bladder and the bladder collapses in size which results in the gas inside the reduced-size container (the bladder) being elevated to a higher pressure. The higher-pressured gas is then transferred to a natural gas pipeline for sale, or to some other mechanical process served by the higher-pressured gas. In the absence of an indirect method of pressurizing the gas, a more-expensive mechanical compressor would have to be used which would increase the cost of recovering the natural gas and result in natural gas reserves being abandoned which could be recovered by using the less-costly indirect compressor.

The present invention is specifically-related to the recovery of economic gas reserves when well-head pressures decline below the minimum suction pressure for conventional mechanical compressors, however, other uses of the equipment may be to collect small amounts of gas produced with oil for which there is no gas pipeline connection, to pressurize it into storage and further pressurize it for disposition by truck transport to a pipeline. Other uses may be to pressurize low-pressure gas from a local utility pipeline (approx. 1 psig) to 1000–1500 psi for compressed natural gas (CNG) fuel in isolated areas.

The flexible bladder is a one-piece cylinder-liner, when filled with gas from a gas well, or other source of low-pressure gas, will inflate substantially to the interior walls of the steel cylinder. The steel cylinder is sized to accommodate a number of fill-empty cycles during a 24 hour period such that the total volume of gas processed in a 24 hour period is substantial and the revenues generated from the sale of such gas will return the investment therein in a short time. The bladder is made of rubberized nylon, or if by choice, some other member of the elastomer family of synthetic rubbers, compatible with natural gas, and certain other gases, and a hydraulic fluid composed of fresh water -antifreeze mix, or mineral hydraulic oil, sealed at one end and the other end open and attached (bonded) to the face of a flange attached to the steel cylinder for pressure containment.

The hydraulic fluid is a matter of choice and can be either a water-antifreeze mix or hydraulic mineral oil.

BRIEF SUMMARY OF THE INVENTION

In the method and system of the invention, an Indirect Pressurization Facility (IPF), consists of gas loading and unloading conduits, gas control mechanisms, pressure and temperature measurement devices, a bladder-equipped steel cylinder pressurization unit and a hydraulic system (pump, prime mover and surge-reservoir tank). The prime mover will be a gas engine and the pressurizer will be a centrifugal pump. Fuel for the prime mover will be natural gas from the gas well or other supply.

Start-up operations will commence with an "on-off" switch, when placed in the "on" position will enable the control panel to signal the valve on the gas supply line to open and gas to flow to the suction of the indirect pressurization facility, and from there to the interior of the bladder. When the amount of gas necessary to fill the bladder is confirmed by a sensor, the fill valve will close and a signal sent to the pressure pump on the hydraulic system to pump hydraulic fluid into the annulus between the outside of the bladder and the interior of the pressurization chamber. When the annulus pressure reaches the pre-set discharge pressure, pumping into the annulus will be discontinued. At this point, the bladder will have collapsed which will compress the gas trapped inside the bladder after which the pressurized gas will be transferred to the gas sales line, or to storage. Following discharge of the gas to sales, the pressurization chamber is de-pressurized by opening the annulus to a reservoir located beneath the steel cylinder which will receive all of the fluid from the annulus at atmospheric pressure and supply the fluid to the suction of the centrifugal pump to pressurize it to the maximum working pressure of the pump and have it ready to commence the next pressurization cycle as soon as the bladder fills with gas from the supply well. The cycle is then repeated as long as the gas well has sufficient producing capacity to load the bladder at atmospheric pressure.

BRIEF SUMMARY OF THE DRAWINGS

Other objects and many attendant advantages of the present invention will become apparent from the following Description of the Preferred Embodiment, when taken with the accompanying drawing FIG. 1 is a diagrammatic view (top) of a skid-mounted Indirect Pressurization Facility.

DETAILED DESCRIPTION OF THE INVENTION

In U.S. patent application Ser. No. 08/454,531 now U.S. Pat. No. 5,603,360, filed by the same inventor of this invention, there is disclosed a method and system for transporting natural gas, from a pipeline to a compressed natural gas (CNG) re-fuel station, inside a flexible bladder within a steel cylinder, and to discharge the transported gas into storage at a CNG re-fuel station with the aid of a hydraulic pump instead of an expensive compressor.

In U.S. patent application Ser. No. 08/615,690, now U.S. Pat. No. 5,676,180 filed by the same inventor of this invention, there is disclosed a method and system for storage and transfer of stored gas to a dispenser to re-fuel automobiles, trucks, and busses.

In U.S. patent application Ser. No. 09/039,272 now U.S. Pat. No. 5,908,141, filed by the same inventor of this invention, there is disclosed a method and system of pressurizing natural gas, at home, or some location other than a re-fuel station, where gas is available at extremely low pressure, from a public utility gas line or other source, and can be pressurized and made available to re-fuel automobiles, trucks, and busses, at a cost less than the cost of CNG facilities utilizing conventional compressors.

The present invention utilizes a bladder-squeeze technique, similar to that used in the above patents, to pressurize natural gas from a gas well when the gas well pressure has declined to a point where it is no longer economically-feasible to gather the gas and compress it utilizing conventional compressors. The recent increases in well-head gas prices has made the gas from these marginally-profitable wells an attractive investment and will add many thousands of cubic feet of gas to the energy pool. Other uses for the equipment might be to collect gas that is being flared (for lack of a gas sales line), and vapor recover systems where tank vapors from oil storage tanks can be collected, compressed and sold by truck transport to a nearby gas sales line Referring now to the drawing. FIG. 1 is the basic Indirect Pressurization Facility (IPB). The skid-mounted unit, generally at (1), contains a hydraulic pressurization vessel (2) which is constructed from conventional oil-field equipment satisfying American Petroleum Institute (API) and/or American Society of Mechanical Engineers (ASME) standards for pressure, volume, and metallurgy in oil and gas field usage. The pressurization vessel (2), is a seamless steel cylinder, made from a short (5 ft) section of API casing (20" nominal size), approximately 1500 psi working pressure, with threaded outlets (3) to accommodate threaded API flanges, on both ends, rated at 1500 psi or more working pressure. Inside the pressurization chamber (2) is a flexible, one-piece bladder (4) with an external surface area approximately the same size as the internal surface area of the steel cylinder (2) into which it will be inserted so that when the natural gas is injected into the bladder (4) it will expand and conform to the shape of the interior of the steel cylinder (2). As the pressure of the confined gas in the bladder (4) increases, the pressure will be contained by the steel walls of the cylinder backing up the bladder (4) material.

On one end of the skid, generally at (5) is a natural gas loading and unloading system On one end of the skid, generally at (5) is a hydraulic gas-pressurization apparatus consisting of conduits (32) and (13) respectfully and entry-control valve (6) and exit-control valve (7). Also, generally at (5), conduit (32) extends to control valve (7) and conduit (36) connects to the gas sales line (not shown), and to a conventional pressure relief valve (8) which is connected to a pressure relief conduit (39). Also, generally at (5) the pressure control flanges, the inner flange (11) and the outer flange (12) provide gas entry access to the interior of the bladder (4) inside the steel pressurization chamber. Gas exit, following pressurization, is accomplished by closing the entry valve (6) and opening the exit valve (7) which is connected to conduit (32). The inner flange (11) is connected to the pressurization chamber by a threaded connection (3) and is also connected to the outer companion flange (12) by bolts (24). Pressure is contained between flanges (11) and (12) by a ring-gasket (27).

On the opposite end of the skid (1), generally at (15) is a hydraulic gas-pressurization apparatus consisting of a hydraulic pump and prime mover (16), a surge tank (17), and a conduit (18) whereby hydraulic fluid is pumped through a conduit (18) to entry-control valve (19) into the annulus (30) between the gas-filled bladder (4) and the inner walls of the steel pressurization chamber (2) where continued hydraulic pressure increase will collapse the bladder (4) and squeeze the gas out of the bladder (4) to the gas exit apparatus on the opposite end of the steel pressurization chamber (2) . After pressurization, the hydraulic fluid is released back to the surge tank (17) through three-way valve (19) and conduit (21). Emergency pressure relief is available through valve (23) where gas can be exhausted to the atmosphere through conduit (14). Valve (22) and conduit (34) provide an outlet to drain the surge tank (17) or through which fluid may be added if necessary.

The present invention contemplates pressurizing natural gas, available at a marginal gas well or small volume gas recovery area. The method of the invention is to accomplish the pressurization without the use of expensive mechanical compressors by creating a flexible compression chamber which can be operated using hydraulic fluid instead of a mechanical piston-like operation.

I claim:

1. A method of boosting the pressure of a natural gas (or other gaseous substances), indirectly, by increasing the pressure of a liquid fluidically in contact with an outside of a flexible bladder temporarily containing and storing the gas, comprising:

a hydraulic compression chamber containing a flexible bladder, which will collapse when high pressure liquid is applied to an outside surface of said flexible bladder, thereby boosting the pressure of the gas trapped inside the bladder; the pressurization continues until it reaches a set pressure above a sales line pressure which allows the gas to exit the compression chamber, into the gas sales line, or other use area;

a hydraulic pump means is fluidically-connected to an annulus between said compression chamber and the flexible bladder whereby increased pumping of a hydraulic fluid increases the pressure in the annulus and squeezes the gas out of the bladder to a gas sales line or other use area;

a gas engine prime mover connected to the hydraulic pump will pressurize the hydraulic fluid to be pumped into the compression chamber;

a conduit means for acquiring natural gas from an acquisition location, to provide gas for compression and provide fuel for the gas engine prime mover;

a means of collecting and temporarily storing the hydraulic fluid in a reservoir, which is evacuated from the annulus between the flexible bladder and the hydrualic compression chamber after each compression cycle, and said reservoir also serving as a supply vessel to the suction of the hydraulic pump to which it is fluidically-connected.

* * * * *